United States Patent [19]

Ruthardt

[11] Patent Number: 4,488,859

[45] Date of Patent: Dec. 18, 1984

[54] APPARATUS FOR MANUFACTURING POWDER BY DIVIDING A MELT

[75] Inventor: Rolf Ruthardt, Hanau am Main, Fed. Rep. of Germany

[73] Assignee: Leybold-Heraeus GmbH, Cologne, Fed. Rep. of Germany

[21] Appl. No.: 502,497

[22] Filed: Jun. 9, 1983

[30] Foreign Application Priority Data

Jun. 18, 1982 [DE] Fed. Rep. of Germany ..... 3233742

[51] Int. Cl.[3] ..... B28B 1/54

[52] U.S. Cl. ..... 425/6; 264/5; 264/13

[58] Field of Search ..... 264/5, 8, 13; 425/6, 425/7, 10

[56] References Cited

U.S. PATENT DOCUMENTS

| | | | |
|---|---|---|---|
| 3,288,892 | 11/1966 | Bewley et al. | 264/13 |
| 3,720,737 | 3/1973 | Klaphaak et al. | 264/13 |
| 4,067,674 | 1/1978 | Devillard | 264/8 |

*Primary Examiner*—Caleb Weston

*Attorney, Agent, or Firm*—Max Fogiel

[57] ABSTRACT

An arrangement for manufacturing powder from a melt by a mechanism for dividing it up. The device has a vertical shaft and a powder outtake that communicates with the shaft through a funnel-shaped housing component. To achieve the objectives of reducing the overall height of such a device and preventing the powder from sintering, the axis of the housing component is perpendicular to the axis of the shaft, and the shaft tilts in a bearing until the axis of the housing component is horizontal.

5 Claims, 1 Drawing Figure

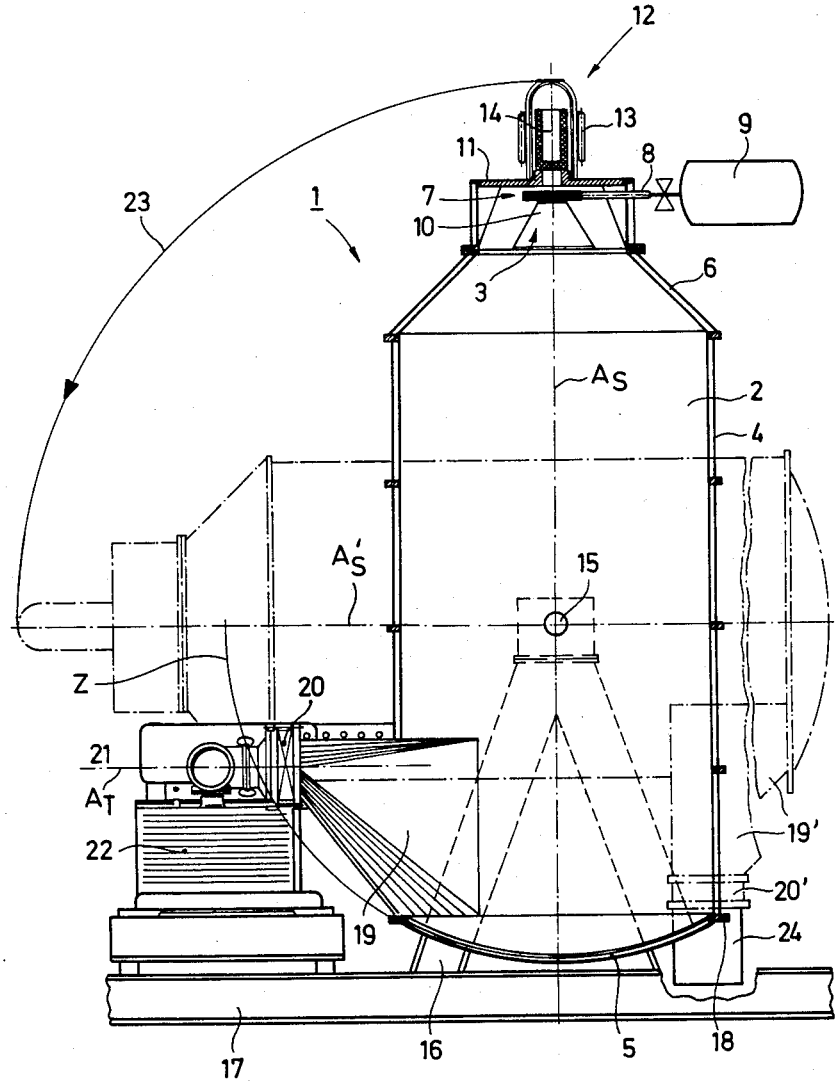
12
14
13
9
11
8
7
10
23
1
3
6
$A_S$
2
4
$A'_S$
15
Z
20
21
$A_T$
22
19'
20'
19
24
17
16
5
18

APPARATUS FOR MANUFACTURING POWDER BY DIVIDING A MELT

The invention concerns a device for manufacturing powder by dividing a melt into particles and then cooling the particles until they harden and consisting of a mechanism for dividing the melt, of a container, which is essentially a vertical shaft with a vertical axis, for cooling the particles, and of a powder outtake that communicates with the shaft through a more or less funnel-shaped housing component with an axis that is essentially parallel to the direction in which the powder flows subject to gravity.

The device is used to manufacture powder from metals, alloys, and non-metals. State of the art includes a number of devices for dividing melts. One involves disks or crucibles that rotate at high speed, with the melt entering the center and flung off over the edge as the result of centrifugal force in the form of extremely fine particles. Oscillators or resonators that vibrate ultrasonically, breaking up a stream of molten material that comes into contact with them into extremely fine droplets and flinging them off, are also known. An especially effective device for dividing a melt consists of a nozzle that blows highly compressed gas over a flowing melt and breaks it up into extremely fine droplets. The melt is as a rule fed into all these devices in the form of a regulated jet of liquid. It is, however, also possible to introduce the starting material in the form of a solid rod that is melted locally at one end and to divide the resulting melt into particles with centrifugal force, ultrasound, and/or a high-speed flow of gas.

In all known processes for manufacturing powder from a melt it is necessary to subsequently harden the droplets into particles by heat abstraction and to cool them adequately before the next stage, which consists of collecting them on the floor of a container. The particles must be cooled to a temperature at which they will not sinter together again once they have been collected in a layer on the floor of the container to prevent the powder, which generally pours well, from being difficult or impossible to remove.

Even though the particles can be subjected to a horizontal component of motion induced by centrifugal force, ultrasonics, or flowing gas to provide more cooling time before they come to rest on the floor of the container, the effect of gravity on their falling behavior or falling time will still be decisive. Falling distance is also highly significant and can be reduced, but only conditionally, by introducing a flow of cooling gas in opposition to the direction of fall.

Vertical shafts, with the material to be divided located at the top and with the bottom shaped more or less like a large funnel, below which there is usually a shutoff mechanism and a powder-collecting container, have usually been employed up to now to cool and collect the particles (cf. German Auslegeschrift No. 2 058 964 and German Offenlegungsschrift No. 528 999).

This design has disadvantages, however. The funnel, which adjoins the shaft coaxially, considerably extends the overall height of the device. Making the funnel shallower would only increase its included angle, which would make the powder harder to extract. Thus, considerations of overall height make it impossible for the funnel to be as slender as desired. An associated drawback is that the powder tends to collect in the lowest, meaning the narrowest, section of the funnel, where it piles up very high, which not only leads to unsatisfactory heat loss but also promotes sintering as a result of unavoidable static pressure in the pile. This can result in downtime.

The present invention is intended as a device of the aforesaid type that is extensively improved in that its overall height is much lower and in that the tendency of the powder to sinter together is largely counteracted.

This objective is achieved in a device of the type initially described and in accordance with the invention in that the longitudinal axis of the funnel-shaped housing component is positioned essentially perpendicular to that of the shaft, in that the shaft is mounted in such a way as to tilt in a bearing, and in that the axis of the funnel can be brought into an essentially vertical position by tilting the shaft.

The design of the device in accordance with the invention makes it possible to manufacture the powder with the longitudinal axis of the shaft essentially vertical and the longitudinal axis of the funnel essentially horizontal and with the powder collecting on the floor of the shaft, which can now be completely flat or slightly concave. The distance the powder must fall in order to cool sufficiently before coming into contact with areas of the inside surface of the shaft or with particles that are already there can be preserved while the overall height can be decreased by approximately the length (measured along its longitudinal axis) of the funnel. The surface on which the powder collects will also be considerably expanded, being essentially identical to the cross-section of the shaft. This will not only distribute the powder over a larger area but will also bring it into closer contact with the cooled floor of the shaft. The pile will also be a lot shallower, which will go a long way toward preventing sintering.

Furthermore, pressure and temperature are conditions that notoriously affect the sintering of particles of powder, and both of these parameters can be considerably reduced by the design of the device in accordance with the invention.

The funnel in the device in accordance with the invention is mounted in principle on the side of the shaft and fits into its surface with a polygonal-to-round transition. A shutoff valve is mounted conventionally at the outlet of the funnel.

Once the melt has been divided up into particles, the shaft, and with it the funnel, is tilted, preferably 90°, around the bearing, bringing the axis of the shaft into an essentially horizonal position and the axis of the funnel into an essentially vertical position. As the shaft tilts, the collected and sufficiently cooled powder pours gradually from the floor of the shaft into the funnel without having another opportunity to sinter at that point. The powder can then be extracted from the funnel by opening the shutoff valve at its outlet into a powder container that is flanged onto the valve.

It will be especially practical if the shaft has a concave floor with a center of curvature located on the longitudinal axis of the shaft and if the funnel-shaped housing component, including its outlet and the shutoff valve, is located inside an imaginary cylinder that has a longitudinal axis coincident with the tilting axis of the shaft and a radius identical to the radius of curvature of the floor. The significance of this measure will be discussed in greater detail in connection with the specification, following. It is a prerequisite for retaining the all components within the cylinder and keeping the overall height of the device at a minimum.

Another advantage of a laterally mounted funnel is that at least one suction mechanism with an intake that can be connected to the outlet of the funnel-shaped housing component when the shaft is in the vertical position can be placed beside the shaft.

Further practical embodiments of the object of the invention are described in the subsidiary claims.

One embodiment of the invention will now be specified by way of example with reference to the single drawing, in which the solid lines show the shaft and funnel in the position they are in while the powder is being produced and the dot-and-dash lines show them in the position that they have been tilted into so that the powder can be extracted.

A device 1 for manufacturing powder by dividing a melt into particles and then cooling the particles until they harden has a shaft 2 with an axis $A_S$ and a mechanism 3 for dividing a melt. Shaft 2 has a cylindrical jacket 4, a spherically concave floor 5, and a conical transitional section 6.

Mechanism 3 for dividing the melt consists of a nozzle 7 that has an annular outlet and that can be connected through a line 8 to a source 9 of compressed gas. Nozzle 7 and a distributor horn 10 are housed in the roof that can be attached to and removed from transitional section 6. A source 12 of molten material in the form of crucible 14 heated by an induction coil 13 is mounted on and can be removed from roof 11. Its bottom, which can be opened and closed and is positioned coaxial to and above nozzle 7, is not illustrated in detail. Shaft 2, especially floor 5 and roof 11, is double-walled, and a coolant circulates inside the wall. The design and operation of both mechanism 3 and molten-material source 12 are state of the art and are therefore not specified. When mechanism 3 is in operation it precipitates droplets of molten metal into shaft 2 that fall through it and, once they have hardened and cooled to the desired temperature, collect on floor 5.

Shaft 2 is mounted with lateral and diametrically opposed pins in a pivot bearing 15 supported in two lateral pillow blocks 16 that only the rear block of is illustrated—in broken lines—and that rest on a base frame 17.

The center of curvature of concave floor 5 is located on longitudinal axis $A_S$ of shaft 2, an axis which passes through pivot bearing 15. Floor 5 is attached to jacket 4 with a flanged joint 18.

A funnel-shaped housing component 19 is attached to cylindrical jacket 4 immediately above flanged joint 18. The transition from shaft to housing is polygonal to round. The longitudnal axis $A_T$ of funnel-shaped housng component 19 is essentially horizontal and the side walls of the component are more or less tangent to cylindrical jacket 4, as will be evident from the drawing.

A shutoff valve 20 is mounted on housing component 19 at a point that is radially farthest from axis $A_S$. When the overall device is in the position illustrated with solid lines, shutoff valve 20 is connected to the suction intake 21 of a suction mechanism 22 in the form of a vacuum pump. In practice, the device will have two shutoff valves 20 so that the gas atmosphere can be maintained in its appropriate parts.

It is important for the funnel-shaped housing component 19, including its outlet and the shutoff valve 20 that is connected to it, to be located inside an imaginary cylinder, with a surface Z, that has a longitudinal axis coincident with the tilting axis of the shaft and a radius R identical to the radius of curvature of the floor. Cylinder surface Z has been projected onto the picture plane of the drawing. Obviously, the bottom edge of shutoff valve 20 will revolve along surface Z in the direction indicated by arrow 23 when shaft 2 tilts. This is the optimal position for shutoff valve 20. Mounting it any lower would unacceptably increase the overall height of the device and mounting it any higher would make it hard to extract the powder because of the resultingly wider included angle of funnel-shaped housing component 19, although deviations from optimal conditions are naturally permissible within certain limits.

Tilting shaft 2 around pivot bearing 15 90° brings the device, with the exception of suction mechanism 22 and possibly of molten-material source 12, into the position illustrated with the dot-and-dash lines, in which the shaft will now have a horizontal longitudinal axis $A_S'$. Housing component 19 will now be in the position indicated by 19' and shutoff valve 20 in that indicated by 20'. A powder outtake 24 is now attached to shutoff valve 20' and the powder obtained in the process can be transferred into it once the valve has been opened.

The device as a whole can be flooded or washed with an inert gas.

As will be evident from the drawing, the longitudinal axis of housing component 19 will, in the tilted position, essentially parallel the direction in which the powder will flow subject to gravity.

It will also be evident from the drawing that there are no dead corners between jacket 4, floor 5, and housing component 19 in which residual powder can collect. Such smooth transitions are especially significant if the same device is employed for powder with a different composition.

The object of the invention is preferably employed to obtain powder from what are called superalloys, which are preferred for the manufacture of components subject to high thermal and mechanical stress.

I claim:

1. Apparatus for manufacturing powder by dividing a melt into particles and then cooling the particles until they harden, comprising: means for dividing the melt; a container comprising a vertical shaft with a vertical axis for cooling the particles; powder discharge means communicating with the shaft through a substantially funnel-shaped housing with a longitudinal axis that is substantially perpendicular to the direction in which the powder flows under gravity prior to the shaft being tilted, said longitudinal axis being substantially parallel to the direction in which the powder flows after said shaft is tilted; said longitudinal axis of the funnel-shaped housing being positioned substantially perpendicular to said shaft; said shaft being mounted for tilting in a bearing; said axis of the funnel being brought into a substantially vertical position by tilting said shaft.

2. Apparatus according to claim 1, wherein said shaft has a roof, a source of molten material is mounted on and is removable from the roof of the shaft and generates a melt.

3. Apparatus according to claim 2, including suction means with an intake connectable to an outlet of the funnel-shaped housing when said shaft is in a vertical position, said suction means being located beside the shaft.

4. Apparatus according to claim 3, including a shutoff valve associated with the outlet of the funnel-shaped housing.

5. Apparatus according to claim 4, wherein said shaft has a concave floor with a center of curvature located on the longtitudinal axis of said shaft, said funnel-shaped housing with its outlet and said shutoff valve being located inside an imaginary cylinder having a longitudinal axis coincident with the tilting of the shaft and a radius identical to the radius of curvature of the floor.

* * * * *